US009528671B2

(12) United States Patent
Ahn et al.

(10) Patent No.: US 9,528,671 B2
(45) Date of Patent: Dec. 27, 2016

(54) LASER OPTICAL SYSTEM FOR HEAD LAMP

(71) Applicants: Hyundai Motor Company, Seoul (KR); Hyundai Mobis Co., Ltd., Seoul (KR)

(72) Inventors: Byoung Suk Ahn, Suwon-si (KR); Tae Won Lee, Yongin-si (KR)

(73) Assignees: Hyundai Motor Company, Seoul (KR); Hyundai Mobis Co., Ltd., Seoul (KR)

( * ) Notice: Subject to any disclaimer, the term of this patent is extended or adjusted under 35 U.S.C. 154(b) by 189 days.

(21) Appl. No.: 14/461,211

(22) Filed: Aug. 15, 2014

(65) Prior Publication Data

US 2015/0176791 A1 Jun. 25, 2015

(30) Foreign Application Priority Data

Dec. 24, 2013 (KR) ..... 10-2013-0162224

(51) Int. Cl.
*F21S 8/10* (2006.01)

(52) U.S. Cl.
CPC ..... *F21S 48/115* (2013.01); *F21S 48/1104* (2013.01); *F21S 48/1145* (2013.01); *F21S 48/13* (2013.01); *F21S 48/1305* (2013.01); *F21S 48/1323* (2013.01); *F21S 48/328* (2013.01)

(58) Field of Classification Search
CPC .. F21S 48/1305; F21S 48/1104; F21S 48/1159
See application file for complete search history.

(56) References Cited

U.S. PATENT DOCUMENTS

2004/0041984 A1* 3/2004 Tani ..... F21V 29/763 353/20
2005/0105301 A1* 5/2005 Takeda ..... F21S 48/1154 362/545
2006/0239022 A1* 10/2006 Inaba ..... B60Q 1/0041 362/538
2007/0098334 A1* 5/2007 Chen ..... F21V 29/004 385/92
2008/0112161 A1* 5/2008 Summers ..... F21S 4/28 362/217.05

(Continued)

FOREIGN PATENT DOCUMENTS

JP 2009-245833 A 10/2009
JP 2012-124054 A 6/2012

(Continued)

*Primary Examiner* — Anh Mai
*Assistant Examiner* — Zachary J Snyder
(74) *Attorney, Agent, or Firm* — Morgan, Lewis & Bockius LLP

(57) ABSTRACT

A laser optical system for a head lamp may include a laser diode emitting light, a PCB substrate to which the laser diode is attached, the PCB substrate controlling supply of current to the laser diode, a fluorescent body located in front of the laser diode, reacting with the light emitted from the laser diode and thereby outputting white light, a guide path located in front of the laser diode and guiding light, which is outputted from the laser diode, to the fluorescent body, and an internal reflecting surface located between the fluorescent body and the guide path and connected to the guide path, the internal reflecting surface reflecting light, which has been incident on the fluorescent body and scattered backwards, to the fluorescent body.

10 Claims, 5 Drawing Sheets

(56) References Cited

U.S. PATENT DOCUMENTS

2008/0179612 A1* 7/2008 Shin ..... H01L 33/486 257/98
2009/0003400 A1* 1/2009 Nagahama ..... H01L 33/483 372/50.23
2009/0095960 A1* 4/2009 Murayama ..... H01L 25/0753 257/79
2009/0116251 A1* 5/2009 Harbers ..... F21V 7/041 362/373
2009/0296367 A1* 12/2009 Sekine ..... H01L 33/60 362/84
2009/0316425 A1* 12/2009 Inoue ..... F21S 48/325 362/547
2010/0046234 A1* 2/2010 Abu-Ageel ..... G02B 3/0006 362/308
2010/0096967 A1* 4/2010 Marinus ..... F04D 33/00 313/46
2011/0044070 A1* 2/2011 Takahashi ..... F21K 9/00 362/553
2011/0063874 A1* 3/2011 Yatsuda ..... F21S 48/1258 362/612
2011/0110107 A1* 5/2011 Kawato ..... F21S 8/026 362/373
2011/0127912 A1* 6/2011 Lee ..... F21S 48/1159 315/32
2011/0157865 A1* 6/2011 Takahashi ..... F21K 9/56 362/84
2011/0215701 A1* 9/2011 Tong ..... F21K 9/00 313/46
2011/0249460 A1* 10/2011 Kushimoto ..... B60Q 1/085 362/510
2013/0170204 A1* 7/2013 Sasamuro ..... F21V 5/04 362/235
2013/0208496 A1* 8/2013 Kishimoto ..... F21V 9/16 362/553
2013/0279159 A1* 10/2013 Pickard ..... F21V 29/505 362/218
2014/0003074 A1* 1/2014 Kishimoto ..... C09K 11/0883 362/510
2014/0020882 A1* 1/2014 Konishi ..... F21V 29/004 165/185
2014/0085923 A1* 3/2014 Nakazato ..... F21S 48/1104 362/558
2014/0153276 A1* 6/2014 Nozaki ..... F21S 48/115 362/551
2015/0062948 A1* 3/2015 Otsubo ..... F21S 48/1104 362/518

FOREIGN PATENT DOCUMENTS

JP 2013-89555 A 5/2013
JP 2013-110005 A 6/2013
JP 2013-152812 A 8/2013
KR 10-2007-0098953 A 10/2007
KR 10-1339159 B1 12/2013

* cited by examiner

LASER OPTICAL SYSTEM FOR HEAD LAMP

CROSS-REFERENCE TO RELATED APPLICATION

The present application claims priority of Korean Patent Application Number 10-2013-0162224 filed on Dec. 24, 2013, the entire contents of which application are incorporated herein for all purposes by this reference.

BACKGROUND OF INVENTION

Field of Invention

The present invention relates to laser optical systems for head lamps, and, more particularly, to a laser optical system for a head lamp, in which, among light outputted from a laser diode, light incident on a fluorescent body and then scattered backwards is incident on the fluorescent body again to obtain an additional quantity of light and thereby increase light efficiency.

Description of Related Art

A head lamp (headlight) of a vehicle is a lamp that lights the front area of a vehicle so as to secure a driver's clear view. The head lamp generally uses halogen, High Intensity Discharge (HID), and a LED diode as a light source.

However, halogen, HID, and LED diode technologies are problematic in that they are high in power consumption, so that they are low in light efficiency. Further, halogen, HID, and LED diode technologies are problematic in that an entire size of an optical system including a light source and a lens is large, so that the degree of freedom in design is low and weight is heavy.

Recently, there is being developed a head lamp using a laser diode as a light source that is environment-friendly and has a long life and high light efficiency.

As shown in FIG. 1, the conventional laser optical system for the head lamp includes a laser diode 1 which generates laser beams of a blue wavelength range, a PCB substrate 2 to which the laser diode 1 is attached and which controls the supply of current to the laser diode 1, a fluorescent body 3 which reacts with light outputted from the laser diode 1 to output white light, a housing 4 which has a guide path 4*a* guiding light, outputted from the laser diode 1, to the fluorescent body 3, and a cover 5 which is coupled to the housing 4 to fix the fluorescent body 3.

Among light that is outputted from the laser diode 1 and then is incident on the fluorescent body 3, some light may be scattered backwards as shown by the arrows indicated by dashed lines. However, the conventional laser optical system of FIG. 1 is problematic in that it is impossible for the backwardly scattered light to be incident on the fluorescent body 3 again, so that an optical loss is caused and light efficiency is deteriorated.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Accordingly, the present invention has been made keeping in mind the above problems occurring in the related art and/or other problems, and the present invention is directed to a laser optical system for a head lamp, in which, among light outputted from a laser diode, light incident on a fluorescent body and then scattered backwards is incident on the fluorescent body again to obtain an additional quantity of light and thereby increase light efficiency.

In addition, the present invention is directed to a laser optical system for a head lamp, in which an internal reflecting surface making backwardly scattered light be incident on a fluorescent body again is integrated with a heat sink, thus prolonging the useful life of the laser optical system and improving durability.

According to various aspects of the present invention, there is provided a laser optical system for a head lamp, including a laser diode emitting light, a PCB substrate to which the laser diode is attached, the PCB substrate controlling supply of current to the laser diode, a fluorescent body located in front of the laser diode, reacting with the light emitted from the laser diode and thereby outputting white light, a guide path located in front of the laser diode and guiding light, which is outputted from the laser diode, to the fluorescent body, and an internal reflecting surface located between the fluorescent body and the guide path and connected to the guide path, the internal reflecting surface reflecting light, which has been incident on the fluorescent body and scattered or reflected backwards, to the fluorescent body.

The laser optical system may further include a front heat sink surrounding and protecting the laser diode, the front heat sink transmitting heat from the laser diode to an outside to dissipate the heat. The laser optical system may further include a rear heat sink which is connected to a rear of the PCB substrate and transmits heat from the laser diode to an outside to dissipate the heat.

The internal reflecting surface may include a reflective coating comprising aluminum or silver deposited to enhance reflecting efficiency. The laser optical system may further include a cover coupled to the front heat sink to fix the fluorescent body. The laser optical system may further include an external reflector coupled to the front heat sink and reflecting the white light outputted from the fluorescent body in a front direction.

The guide path and the internal reflecting surface may be integrally or monolithically formed on the front heat sink. The internal reflecting surface may be closed by the cover.

The guide path may be formed in a shape of a cylinder, a diameter of which is gradually increased in a direction from a first end thereof communicating with the laser diode to a second end thereof communicating with the internal reflecting surface, wherein left and right sides on a cross-section of the guide path may be substantially parallel to and positioned outside left and right lines that are defined by connecting a center of the laser diode to left and right ends of a corresponding cross-section of a base of the fluorescent body, respectively, to allow the light emitted from the laser diode to be incident on the fluorescent body, and the left and right sides on the cross-section of the guide path may be substantially symmetric to each other with respect to a vertical line that passes through the center of the laser diode.

The internal reflecting surface may include an elliptical curved surface, and a length of a horizontal section of the internal reflecting surface may be larger than a length of a corresponding horizontal section of the fluorescent body such that the fluorescent body is located in the elliptical curved surface of the internal reflecting surface.

A lower vertex of the internal reflecting surface formed in the elliptical curved surface may be located on the vertical line passing through the center of the laser diode, and a distance from the lower vertex to the center of the laser diode may be equal to or less than ¼ of a distance from the center of the laser diode to the fluorescent body along the vertical line. Left and right vertices in the cross-section of the internal reflecting surface formed in the elliptical curved surface may be located on a horizontal line obtained by extending the base of the fluorescent body in a horizontal direction.

As is apparent from the above description, the laser optical system is advantageous in that the quantity of laser beams incident on the fluorescent body via the internal reflecting surface provided between the laser diode and the fluorescent body can be significantly increased, thus resulting in considerable improvement in light efficiency, and in that the number of laser diodes serving as the light source can be reduced owing to the improvement in light efficiency, thus achieving reduction in cost and weight and considerably decreasing the entire size of the optical system.

The methods and apparatuses of the present invention have other features and advantages which will be apparent from or are set forth in more detail in the accompanying drawings, which are incorporated herein, and the following Detailed Description, which together serve to explain certain principles of the present invention.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
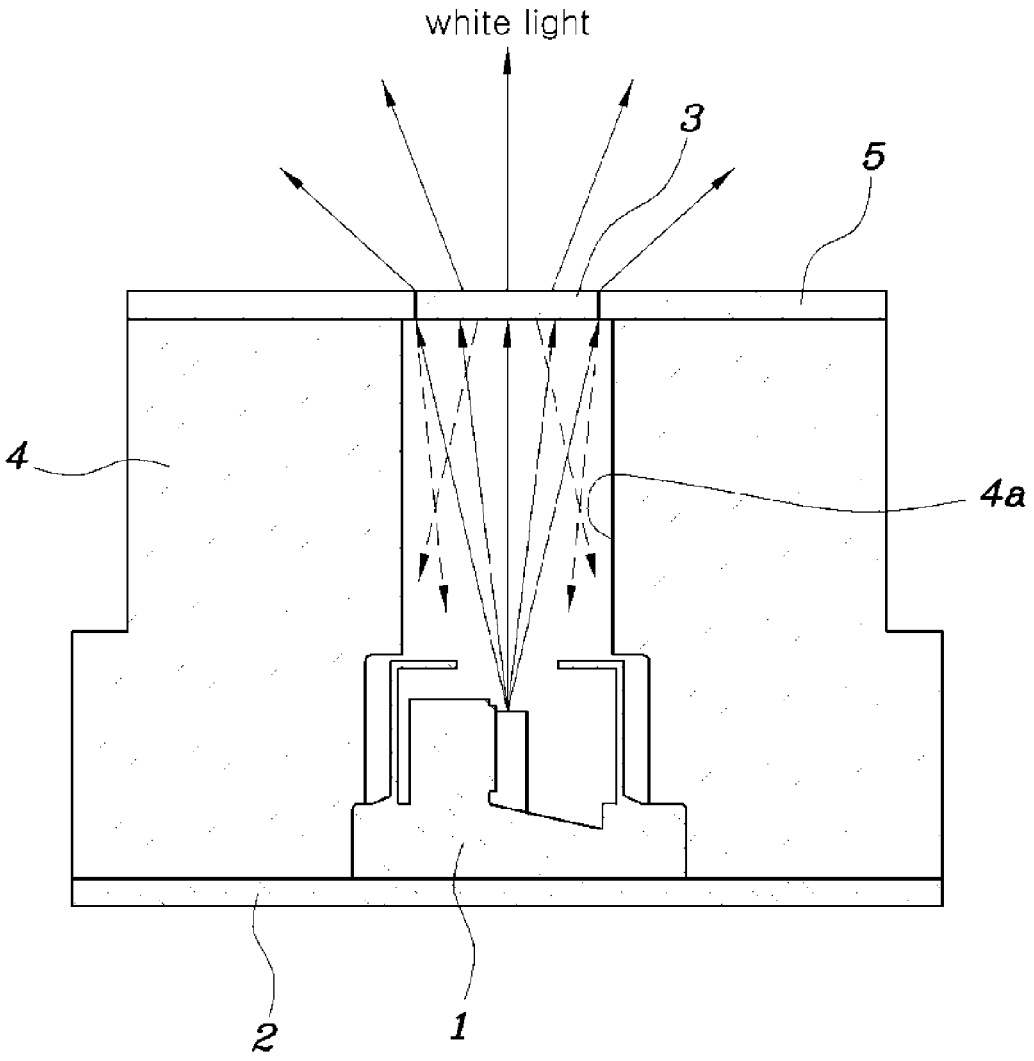
FIG. 1 Related Art
FIG. 1 is a view showing a conventional laser optical system for a head lamp.
Figure 2:
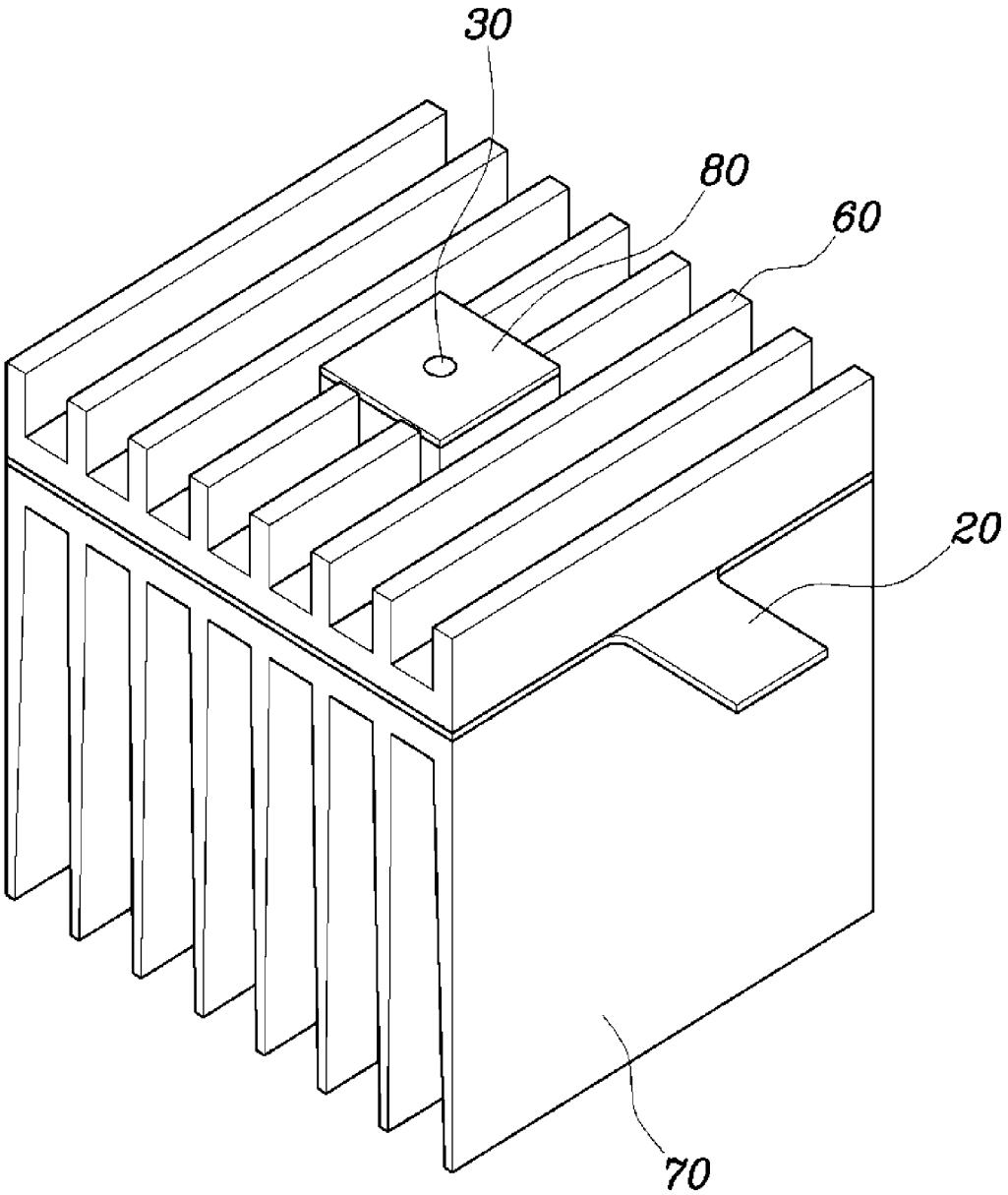
FIG. 2 is a perspective view showing an exemplary laser optical system for a head lamp according to the present invention.
Figure 3:
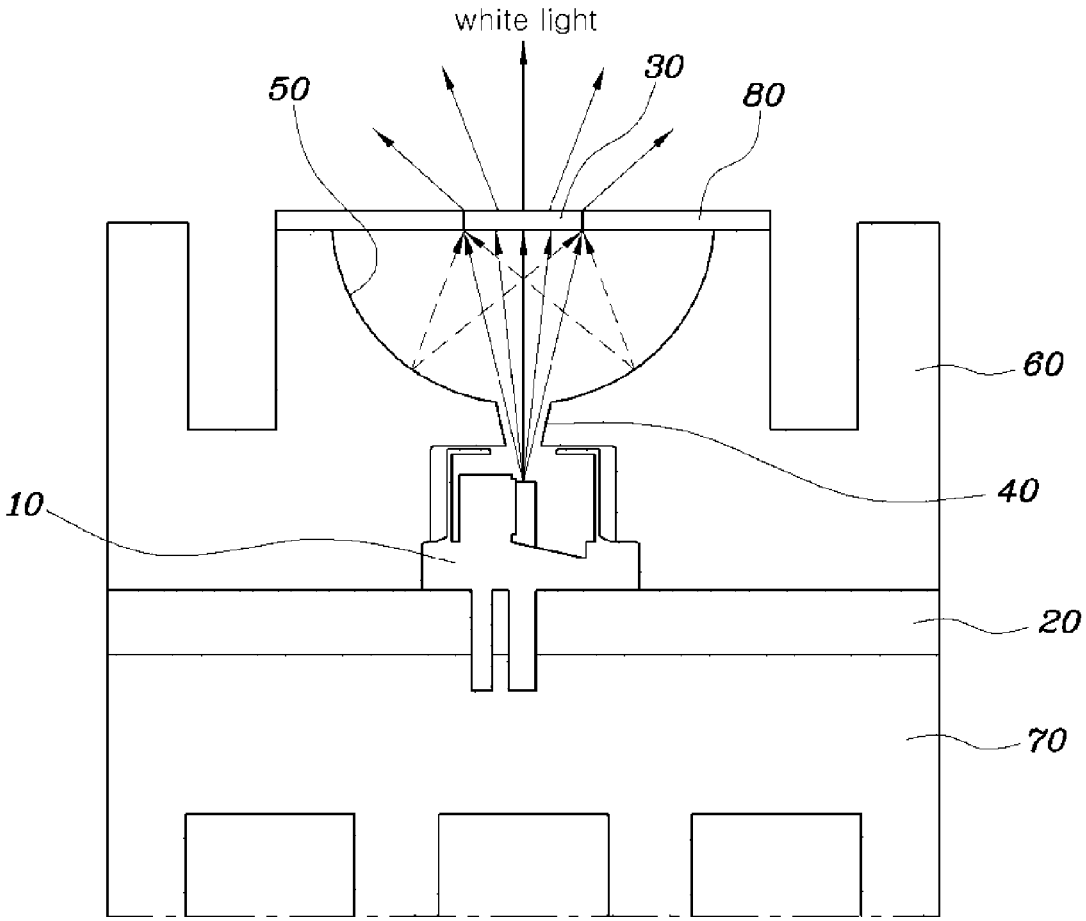
FIG. 3 is a sectional view of FIG. 2.
Figure 4:
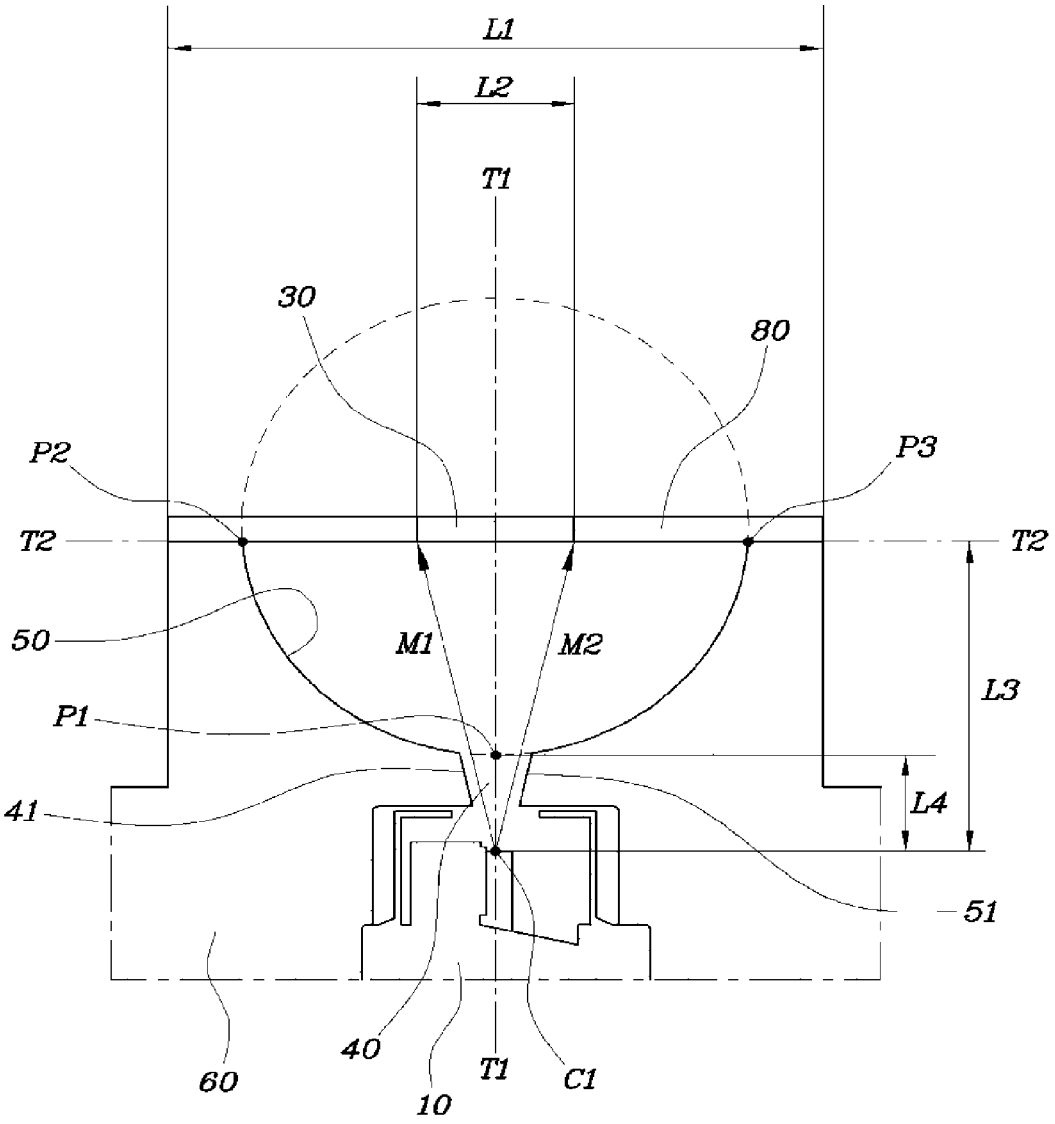
FIG. 4 is a view illustrating an exemplary internal reflector according to the present invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

As shown in FIGS. 2 to 5, the laser optical system for the head lamp according to the present invention includes a laser diode 10 generating a laser beam of a blue wavelength (e.g., generally a short wavelength of about 450 nm) range, a PCB substrate 20 to which the laser diode 10 is attached and which controls supply of current to the laser diode 10, a fluorescent body 30 which is located in front of the laser diode 10, reacts with light emitted from the laser diode 10 and thereby outputs white light, a guide path 40 which is located in front of the laser diode 10 and guiding light, outputted from the laser diode 10, to the fluorescent body 30, and an internal reflecting surface 50 which is located between the fluorescent body 30 and the guide path 40, is connected to the guide path 40, and reflects light, incident on the fluorescent body 30 and scattered backwards, to the fluorescent body 30 back.

The laser optical system further includes a front heat sink 60 which surrounds and protects the laser diode 10 and transmits heat from the laser diode 10 to the outside to dissipate heat, a rear heat sink 70 which is connected to a rear of the PCB substrate 20 and transmits heat from the laser diode 10 to the outside to dissipate the heat, and a cover 80 which is coupled to the front heat sink 60 to fix the fluorescent body 30.

In other words, the laser optical system according to the present invention is configured to have the internal reflecting surface 50 between the laser diode 10 and the fluorescent body 30. All of the light outputted from the laser diode 10 is incident on the fluorescent body 30, and most of the light incident on the fluorescent body 30 reacts with the fluorescent body 30 to output the white light forwards.

Further, some light (shown by the arrows indicated by FIG. 3) which is incident on the fluorescent body 30 and then is not excited in the fluorescent body 30 but is scattered backwards is reflected by the internal reflecting surface 50 and then is incident on the fluorescent body 30 again. Thereby, all the light outputted from the laser diode 10 reacts with the fluorescent body 30 and thereby is outputted in the white light.

The above-mentioned configuration of the internal reflecting surface 50 can eliminate the optical loss caused by the light scattered rearwards, thus obtaining the additional quantity of light and thereby significantly improving light efficiency.

A double heat dissipating function by the front heat sink 60 and the rear heat sink 70 can prolong the useful life of the laser diode 10 and the PCB substrate 20 and considerably improve the durability thereof. The internal reflecting surface 50 undergoes deposition using aluminum with good reflecting performance or silver reflecting coating so as to maximize reflecting efficiency.

According to the present invention, the guide path 40 and the internal reflecting surface 50 are integrally or monolithically formed on the front heat sink 60. Thus, a separate structure corresponding to the guide path 40 and the internal reflecting surface 50 is not required, thus achieving reduction in weight and cost. Further, the internal reflecting surface 50 is closed by the cover 80, thus preventing the leakage of light and maximizing light efficiency.

According to the present invention, the guide path 40 is formed in or substantially in a shape of a cylinder, a diameter of which is gradually increased in a direction from a first end thereof communicating with the laser diode 10 to a second end thereof communicating with the internal reflecting surface 50.

Further, left and right sides 41 and 42 on a section of the guide path 40 are parallel or substantially parallel to and are positioned outside left and right lines M1 and M2 which are defined by connecting a center C1 of the laser diode 10 to left and right ends of a base of the fluorescent body 30, respectively, to allow all light outputted from the laser diode 10 to be incident on the fluorescent body 30. The left and right sides 41 and 42 on the section of the guide path 40 are symmetric or substantially symmetric to each other with respect to a vertical line T1 that passes through the center C1 of the laser diode 10. Such a shape of the guide path 40 provides a path to allow all the light outputted from the laser diode 10 to be stably incident on the fluorescent body 30 without optical loss.

Further, according to the present invention, the internal reflecting surface 50 is formed in an elliptical curved surface. A length L1 of a horizontal section of the internal reflecting surface 50 is formed to be larger than a length L2 of a horizontal section of the fluorescent body 30 in such a way that the fluorescent body 30 is located in the elliptical curved surface of the internal reflecting surface 50. Such a configuration allows all the light, which is incident on the fluorescent body 30 and then does not react with the fluorescent body 30 and is scattered rearwards, to be reflected again and be incident on the fluorescent body 30 again.

A lower vertex P1 of the internal reflecting surface 50 formed in the elliptical curved surface is located on the vertical line T1 passing through the center C1 of the laser diode 10 in such a way as to be within a range from the center of the laser diode to ¼ of a length or distance L3 from the center C1 of the laser diode 10 to the fluorescent body 30 along the vertical line T1.

In other words, the lower vertex P1 of the internal reflecting surface 50 is as near as possible to the center C1 of the laser diode 10, thus reducing the length of the guide path 40 to the maximum, and reducing the optical loss in the guide path 40, therefore contributing to improve light efficiency.

Further, left and right vertices P2 and P3 of the internal reflecting surface 50 formed in the elliptical curved surface are formed to be located on a horizontal line T2 obtained by extending a base of the fluorescent body in a horizontal direction. That is, the left and right vertices P2 and P3 of the internal reflecting surface 50 are aligned with surfaces at which the front surface of the front heat sink 60 meets the cover 80, so that it is possible to maximize the area of the internal reflecting surface 50 and thereby ensure a reflecting surface having a maximum area.

Figure 5:
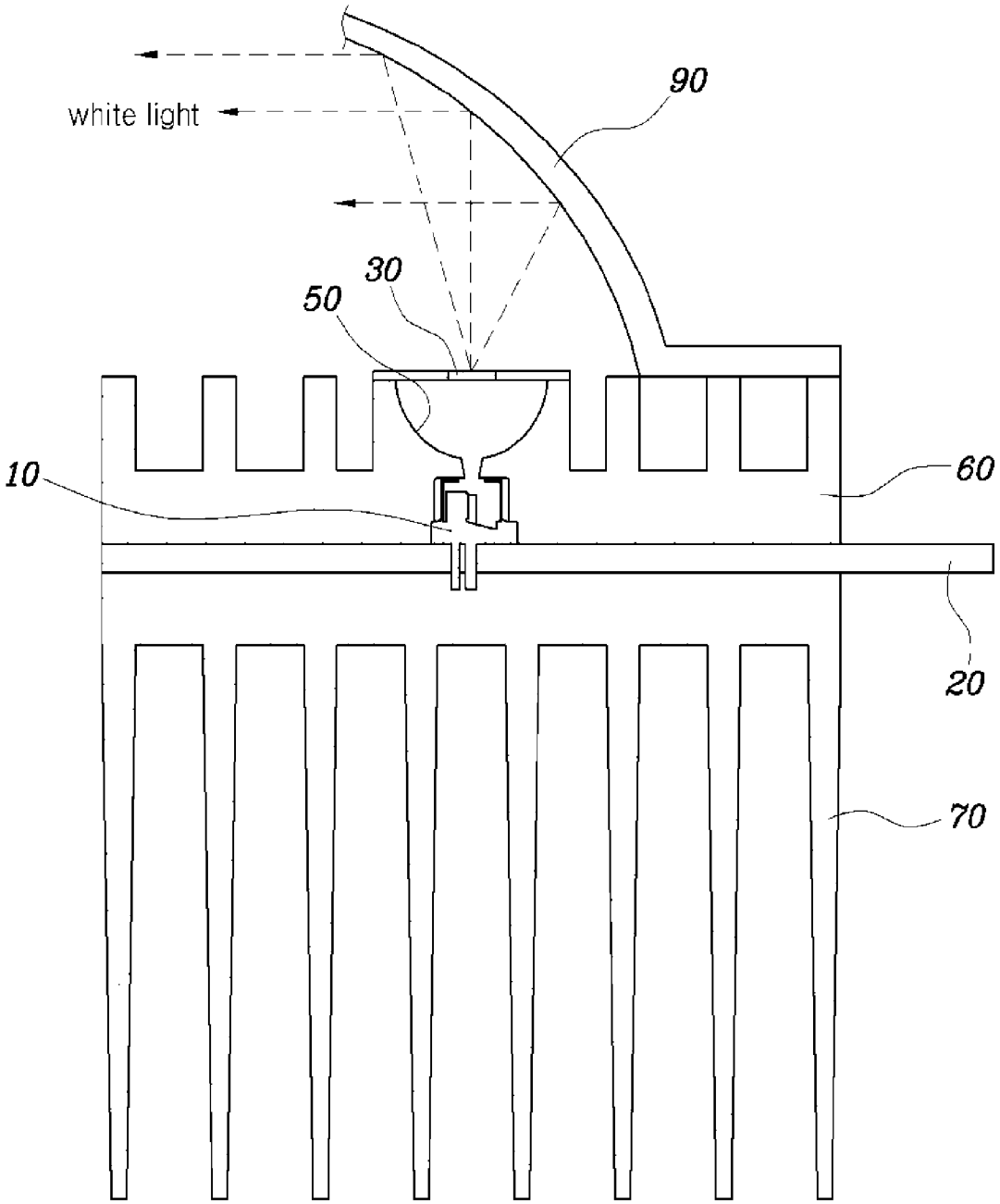
FIG. 5 is a sectional view showing an exemplary laser optical system for a head lamp including an exemplary external reflector according to the present invention.

As shown in FIG. 5, in some embodiments, the laser optical system according to the present invention further includes an external reflector 90 which is coupled to the front heat sink 60. The external reflector 90 is installed to have the fluorescent body 30, thus serving to reflect, white light outputted through the fluorescent body 30, in a front direction.

As described above, the present invention provides a laser optical system for a head lamp, in which an internal reflecting surface provided between a laser diode and a fluorescent body again reflects light, which is incident on the fluorescent body and then is not excited in the fluorescent body but is scattered backwards, to allow the light to be incident on the fluorescent body again, thus obtaining the additional quantity of light incident on the fluorescent body without an optical loss caused by the backwardly scattered light, and resulting in significant improvement in light efficiency of the head lamp.

Further, the present invention provides a laser optical system for a head lamp, in which, if the light efficiency of the laser optical system can be improved via an internal reflecting surface, the number of laser diodes serving as a light source can be reduced, thus achieving reduction in cost and weight and enabling the entire size of the optical system to be remarkably reduced.

Furthermore, the present invention provides a laser optical system for a head lamp, in which a double heat dissipating function by front and rear heat sinks can prolong the useful life of a laser diode and a PCB substrate and considerably improve durability thereof.

For convenience in explanation and accurate definition in the appended claims, the terms "left" or "right", "front" or "rear", "inside" or "outside", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A laser optical system for a head lamp, comprising:

a laser diode emitting light;

a PCB substrate to which the laser diode is attached, the PCB substrate controlling supply of current to the laser diode;

a fluorescent body located in front of the laser diode, reacting with the light emitted from the laser diode and thereby outputting white light;

a guide path located in front of the laser diode and guiding light, which is outputted from the laser diode, to the fluorescent body;

an internal reflecting surface located between the fluorescent body and the guide path and connected to the guide path, the internal reflecting surface reflecting light, which has been incident on the fluorescent body and scattered or reflected backwards, to the fluorescent body; and a front heat sink surrounding and protecting the laser diode, the front heat sink transmitting heat from the laser diode to an outside to dissipate the heat, wherein the guide path and the internal reflecting surface are integrally or monolithically formed on the front heat sink.

2. The laser optical system as set forth in claim 1, further comprising:

a rear heat sink connected to a rear of the PCB substrate, and transmitting heat from the laser diode to an outside to dissipate the heat.

3. The laser optical system as set forth in claim 1, wherein the internal reflecting surface includes a reflective coating comprising aluminum or silver deposited to enhance reflecting efficiency.

4. The laser optical system as set forth in claim 1, further comprising:

a cover coupled to the front heat sink to fix the fluorescent body.

5. The laser optical system as set forth in claim 1, further comprising:

an external reflector coupled to the front heat sink and reflecting the white light outputted from the fluorescent body in a front direction.

6. The laser optical system as set forth in claim 1, wherein the internal reflecting surface is closed by the cover.

7. The laser optical system as set forth in claim 1, wherein the guide path is formed in a shape of a cylinder, a diameter of which is gradually increased in a direction from a first end thereof communicating with the laser diode to a second end thereof communicating with the internal reflecting surface, wherein:

left and right sides on a cross-section of the guide path are substantially parallel to and positioned outside left and right lines that are defined by connecting a center of the laser diode to left and right ends of a corresponding cross-section of a base of the fluorescent body, respectively, to allow the light emitted from the laser diode to be incident on the fluorescent body; and the left and right sides on the cross-section of the guide path are substantially symmetric to each other with respect to a vertical line that passes through the center of the laser diode.

8. The laser optical system as set forth in claim 7, wherein the internal reflecting surface includes an elliptical curved surface, and a length of a horizontal section of the internal reflecting surface is larger than a length of a corresponding horizontal section of the fluorescent body such that the fluorescent body is located in the elliptical curved surface of the internal reflecting surface.

9. The laser optical system as set forth in claim 8, wherein a lower vertex of the internal reflecting surface formed in the elliptical curved surface is located on the vertical line passing through the center of the laser diode, and a distance from the lower vertex to the center of the laser diode is equal to or less than ¼ of a distance from the center of the laser diode to the fluorescent body along the vertical line.

10. The laser optical system as set forth in claim 8, wherein left and right vertices in the cross-section of the internal reflecting surface formed in the elliptical curved surface are located on a horizontal line obtained by extending the base of the fluorescent body in a horizontal direction.

* * * * *